United States Patent [19]

Thompson

[11] Patent Number: 4,775,156

[45] Date of Patent: Oct. 4, 1988

[54] BOLT REINFORCED, LAMINATED GOLF CLUB HEAD

[76] Inventor: Stanley C. Thompson, 2707 S. Fairfax Ave., Culver City, Calif. 90232

[21] Appl. No.: 31,535

[22] Filed: Mar. 30, 1987

[51] Int. Cl.[4] ..... A63B 53/04

[52] U.S. Cl. ..... 273/171; 273/172; 273/174

[58] Field of Search ..... 273/172, 174, 171, 167 A, 273/167 F, 169, 170, 173, 175

[56] References Cited

U.S. PATENT DOCUMENTS

| | | | |
|---|---|---|---|
| 1,349,806 | 8/1920 | Booth | 273/172 |
| 1,431,313 | 10/1922 | Lawton | 273/172 |
| 3,761,095 | 9/1973 | Thompson | 273/174 |
| 4,162,794 | 7/1979 | Thompson | 273/174 |

*Primary Examiner*—George J. Marlo

*Attorney, Agent, or Firm*—William W. Haefliger

[57] ABSTRACT

A golf club head has multiple laminations above a sole plate defining a keel, a bolt connects to the sole plate above the keel and holds the lamination positively clamped together.

7 Claims, 3 Drawing Sheets

BOLT REINFORCED, LAMINATED GOLF CLUB HEAD

BACKGROUND OF THE INVENTION

This invention relates generally to golf clubs, and more particularly concerns improvements in woods which employ heads made up of stacked laminations, and metallic plates attached to the undersides of such heads. More specifically, it concerns improvements to clubs of the type disclosed in my U.S. Pat. No. 3,761,095, disclosing a sole plate having a keel configuration.

When impact loads are transmitted to such metallic sole plates, the loads are typically transmitted to the wooden heads at points adjacent the plates. Where head laminations extend parallel to the plate, the load is transmitted to the few laminations adjacent the edges of the plate, and a tendency to destructive delamination can occur, particularly when a relatively immovable object such as a concealed rock is inadvertently struck. This problem is aggravated in that type of club disclosed in U.S. Pat. No. 3,761,095, wherein the sole plate carries a downwardly projecting keel which is more likely to strike objects concealed in the turf or ground. The attachment of such sole plates to the laminations as by screws is not an answer to the problem, since the edges of the threads form cracks in or between the laminations, encouraging delamination.

SUMMARY OF THE INVENTION

It is a major object of the invention to provide an improved lamination locking bolt, and cooperating sole plate, which take advantage of the keel structure to obviate the above described delamination problem. As will appear, the invention incorporates:

(a) there being a recess which extends generally vertically in said laminations from the sole plate upwardly, (b) and a bolt extending in that recess, (c) the bolt connected with the sole plate above the keel, (d) and the bolt including flange means proximate said head top surface, the bolt acting to clamp the laminations toward one another between said flange means and the sole plate.

As will appear, the recess typically defines a bore and a counterbore, the counterbore receiving the flange means, and the bolt having a shank received in the bore below said counterbore; also, the flange means may typically comprise a bolt head integral with a shank defined by the bolt, the shank lower end having external threading threadably attached to the sole plate. The sole plate may form a second recess sunk downwardly therein, and into the keel, the bolt threading extending into said second recess; and adhesive bonding material in said bore and counterbore bonding the bolt and flange means to the laminations which are wooden. Finally, weights may be located in the sole plate, fore and aft of the bolt receiving recess.

These and other objects and advantages of the invention, as well as the details of an illustrative embodiment, will be more fully understood from the following description and drawings, in which:

DRAWING DESCRIPTION

Figure 4:
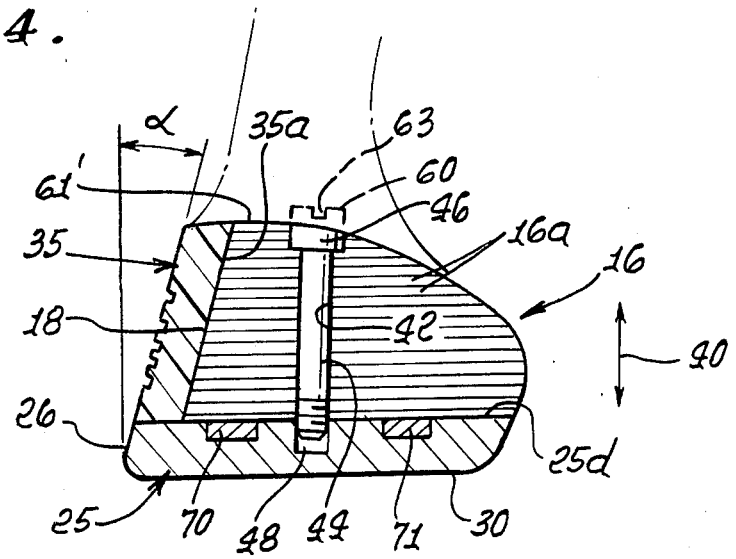
FIG. 4 is an elevation taken in section on lines 4—4 of FIG. 3.
Figure 4A:
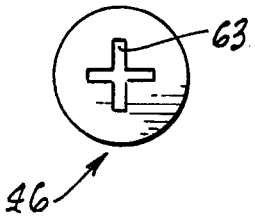
Figure 5:
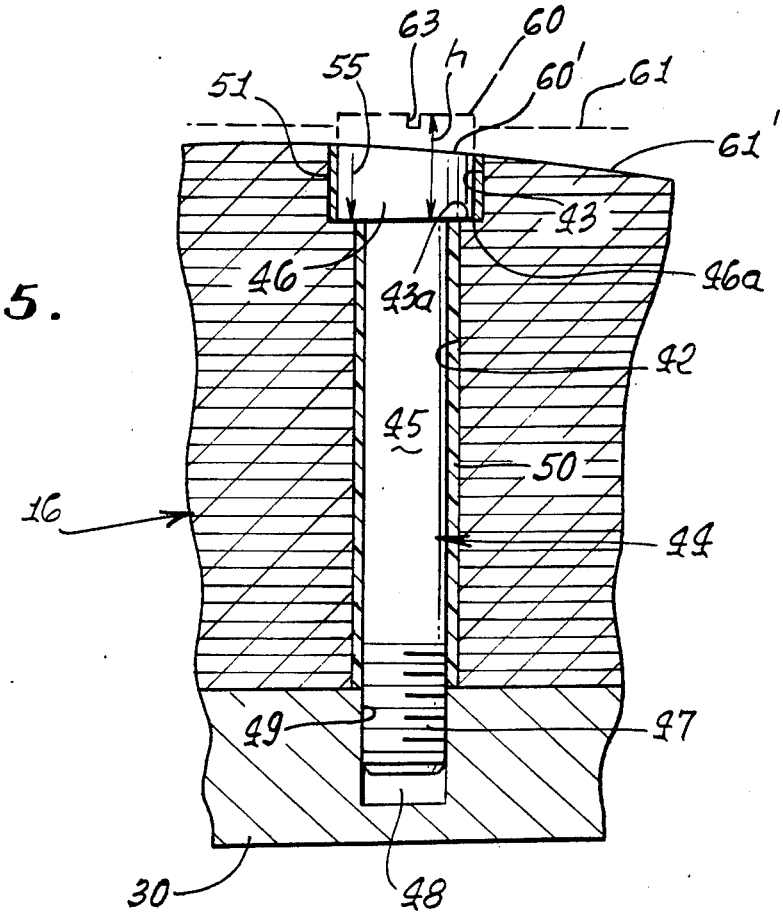
Figure 6:
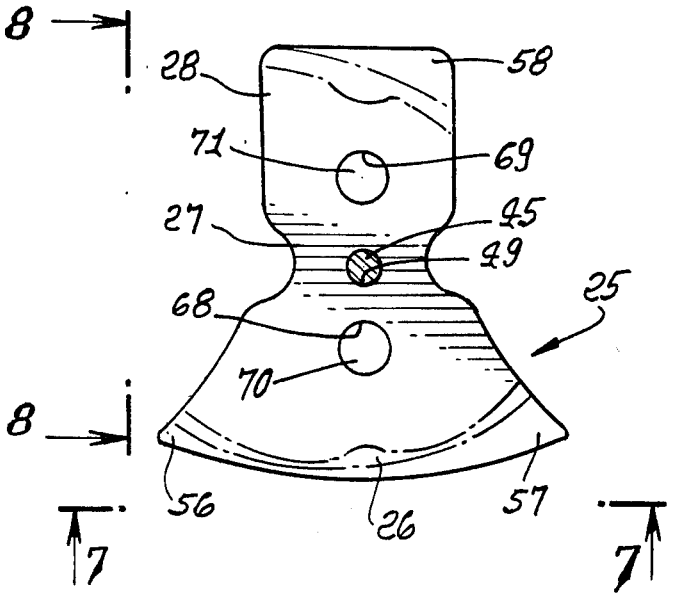
Figure 7:
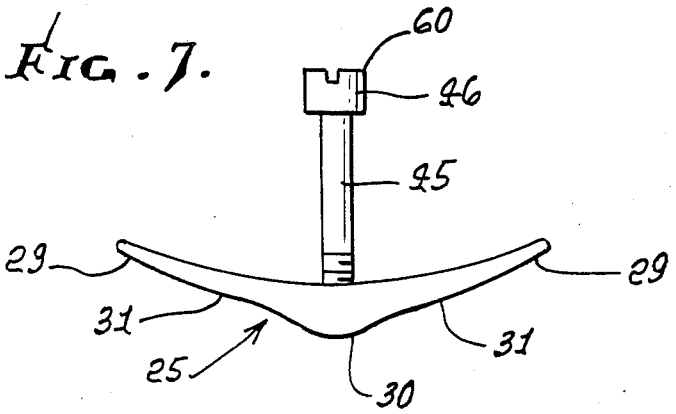

FIG. 4*a* is a top plan view showing the original surface of the bolt head;

FIG. 5 is an enlarged view of the bolt in position in the head;

FIG. 6 is a bottom plan view of the insert plate in as-molded condition, i.e. before trimming;

FIG. 7 is an end elevation on lines 7—7 of FIG. 6, and

Figure 8:
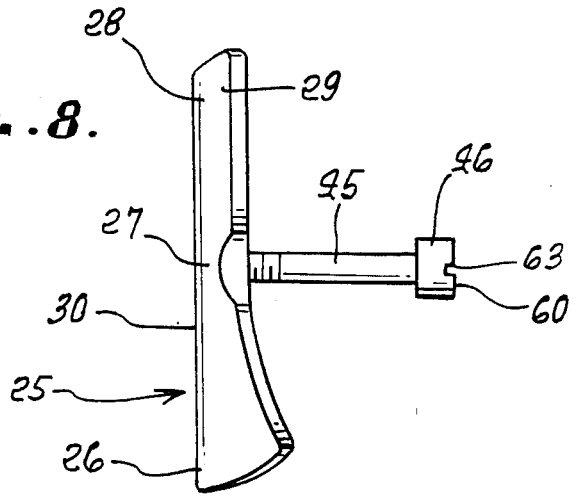

FIG. 8 is a side elevation on lines 8—8 of FIG. 6.

DETAILED DESCRIPTION

Figure 1:
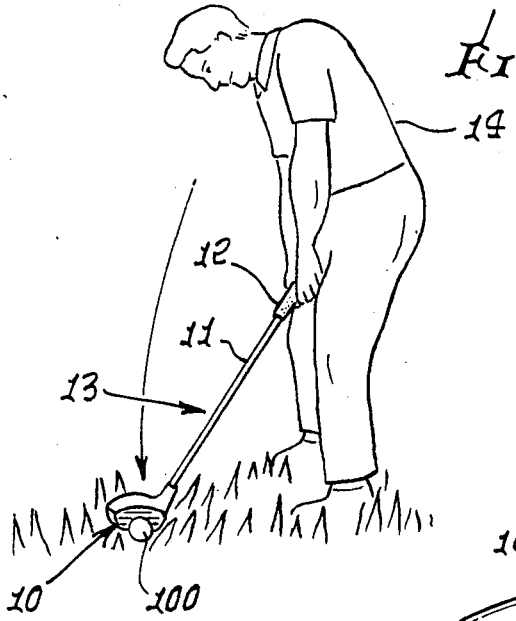
FIG. 1 is frontal elevation showing use of the golf club.

Referring now to the drawings and particularly to FIG. 1, a golf club head embodying the present invention is generally indicated at 10 and is shown secured to a shaft 11. The latter has a conventional grip 12 to form an improved golf club 13. The club 13 is shown in hands of a golfer 14, just as the head 10 is about to engage the ball. At best seen in FIG. 2, the golf club 10 generally includes an upwardly extending shaft receiving hosel 15, a body 16, and a sole plate 25.

The golf club head 10 is shown in the preferred embodiment as being a "wood", with the wooden body 16 having front face 17. The latter may be of any conventional incline to the vertical, as indicated by angle $\alpha$ in FIG. 4. The front face 17 has a centrally located cutout 18 for a trapezoidal panel 35. The body 16 is bulged at 19 behind the front face 17 as is a conventional for a wood. The body 16 also has a lower surface 20 with a cutout 21 for receiving the sole plate 25. The cutout 21 follows the shape of the sole plate 25 to be fitted therein, and has centrally located, opposed peninsulas 22 to locate the sole plate 25 with respect to the body 16. The sole plate may consist, for example of cast metal such as zinc or zinc aluminum alloy.

Figure 2:
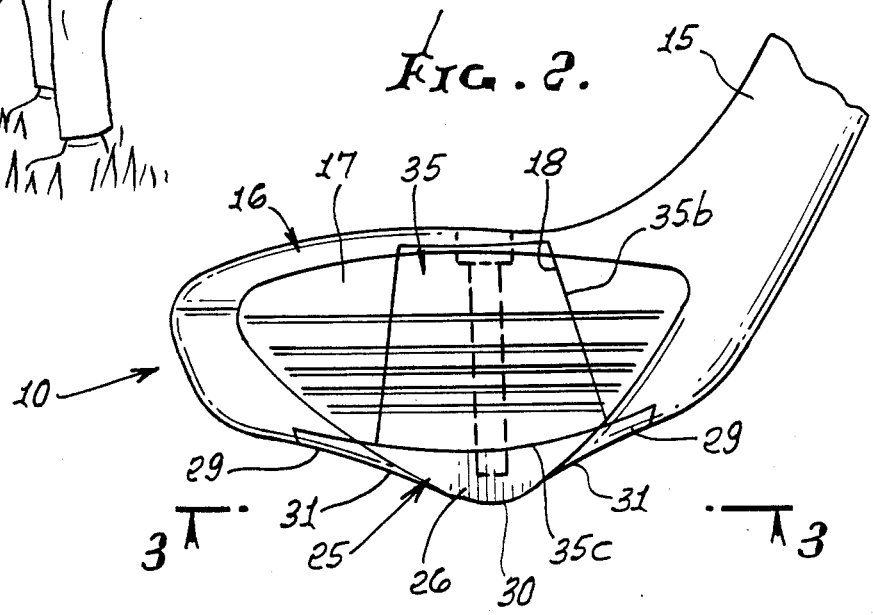
FIG. 2 is a frontal elevation showing a golf club head that incorporates the invention.
Figure 3:
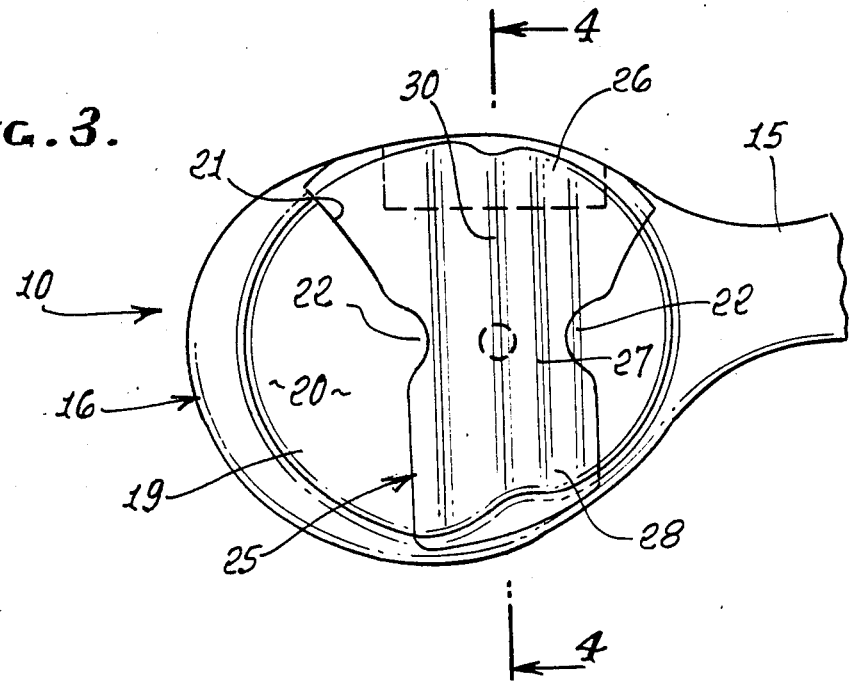
FIG. 3 is a bottom plan view on lines 3—3 of FIG. 2.

As best seen in FIGS. 2 and 3, the sole plate 25 is shaped to mate with cutout 21 in the lower surface 20 of the body 16. The sole plate 25 has a shallow V-shaped front face 26 which, when the sole plate 25 is located in the cut-out 21, provides an extension of the front face 17 of the body 16. The front face 26 is relatively wide and the sole plate 25 extends rearwardly therefrom to narrow into a waist 27 before spreading again at the rear end portion 28. The waist 27 mates with the centrally located opposed body peninsulas 22 to locate the sole plate 25 with respect to the body 16. The sole plate 25 is secured within the cut-out 21 in the lower surface 20 of the body 16 by a bonding agent such as epoxy to bond the sole plate 25 and the body 16 together.

As seen in FIG. 2, the sole plate 25 has a lower surface 29 from which a longitudinally rearwardly and forwardly elongated keel 30 protrudes downwardly. In FIG. 3, the longitudinal keel 30 extends generally centrally from the front face 26 rearwardly along a line corresponding to the path of swing of the front face of the golf club head 10. The bottom of the keel 30, being lowermost, typically contacts the ground before the ball 100 is truck to space the major portion 29 of the lower surface of the plate 25 and lower surface 20 of the body 16 from the ground. Thus the area of contact with the ground is only the bottom of the keel 30.

In the preferred embodiment, keel 30 has downwardly concave sides 31. (See FIG. 2). The concave sides 31 blend smoothly with the downwardly convex keel 30 and the major portion 29 of the lower surface of plate 25. They tend to set up a favorable air flow over the lower surfaces 29 and 30 of the club head 10 as the club 13 is swung through the air; further, as the head 10 passes through the air, the keel 30 splits the air ahead of the club head 10 and the concave sides 31 direct the air outwardly as it passes over the lower surfaces 29 and 20. This pattern of air flow tends to separate and bend the grass as the head 10 approaches the ball (see FIG. 1) rather than crush the grass as the conventional flat bottomed head does.

The golf club head 10 is completed by the insertion of the trapezoidal panel 35 in the cutout 18 on the front face 17 of the body 16. The panel 35 typically consists of a hard plastic material which can engage a ball repeatedly without becoming dented or worn as the wood of the body 16 would otherwise become if such a panel 35 were not provided. A suitable bonding agent such as an epoxide may be employed to bond the rear wall **35*a* sides 35*b* and bottom 35*c* of the insert to corresponding surfaces of the body and of the sole plate 25**.

As shown in FIG. 4, the body 16 is typically defined by a vertical stack of generally horizontal and parallel laminations **16*a* consisting of wooden sheets bonded together at interfaces. As an example, there may be between 17 and 19 such laminations per inch in the direction of arrows 40 in FIG. 4. The strength of the club head, to resist impact of the ball, is thereby enhanced. However, the rather shallow thickness of the sole plate, in the direction of arrows 40, causes stress concentration at the lowermost laminations 16*a*, i.e. those below the level of the upper surface 25*d* of the plate 25**, since at times the full impact load of the club head against a concealed rock or other object is transmitted from the sole plate to such lowermost laminations. This can cause destructive delamination in the absence of the present invention.

In accordance with the invention, and extending the description to FIG. 5, a recess extends generally vertically above the keel 30 in the laminations, from the sole plate upwardly. The recess typically defines a bore 42 and a counterbore 43. A bolt 44 extends in the recess and is connected with the sole plate directly above the bottom of keel 30; also the bolt has flange means proximate the head top surface, i.e. within the counterbore 43, while the bolt shank 45 extends in bore 42. The bolt acts to clamp the laminations toward one another between the flange means and the sole plate, thereby to positively prevent delamination.

More specifically, the flange means defines a bolt head 46 integral with the shank 45; and the lower end of the shank is externally threaded at 47 to threadably attach to the sole plate. As shown, the metallic sole plate forms a second recess 48 which is internally threaded at 49 to receive the bolt threads 47. The head includes a downwardly facing step shoulder **46*a* which clamps downwardly against the counterbore step shoulder 43*a*, when the bolt is tightened, to compress the laminations. See force arrows 55. Epoxy resin fills at 50 the clearance between the shank 45 and bore 42, and fills at 51 the clearance between head 46 and counterbore 43, the resin having been introduced into the clearances at the time of bolt assembly to the head. After curing, the resin locks the bolt to the head, whereby unthreading rotation of the bolt is prevented. Note that the depth of the sole plate at the keel allows the recess 48 to extend downwardly into the keel to a depth greater than the sole plate thickness at its peripheral regions that conform to the shape of cut-out 21, whereby effective, high strength, generally centralized gripping of the sole plate by the bolt at threads 47 and 49** is achieved. The bolt typically consists of lightweight metal, such as aluminum, for example, whereby its presence in the club head i.e. the center of gravity of the head, is not raised. In this regard, the specific gravity of aluminum is 2.56, and the specific gravity of the sole plate zinc composition is about 6.85.

FIGS. 4 and 5 also indicate the original height "h" of the bolt head with a top surface at 60 extending above the original top surface level 61 of the wooden head. Note the slot 63 in the bolt head. Finish grinding of the club head, and bolt head, eliminates the slot 63 and lowers the bolt head top surface to level 60', flush with the reduced top surface level 61' of the wooden head.

FIG. 6 illustrates the provision of two additional openings 68 and 69 projecting in the sole plate 25 at opposite sides of recess 49, in the direction of club head travel. Such openings are of larger diameter than the diameter of the bolt shank 45. Concealed weights 70 and 71 are fitted in the recesses, as is clear from FIG. 5. The weights are typically bonded in position, in their associated openings and their specific gravities exceed the specific gravities of the bolt and sole plate. One example is tungsten. See also FIG. 4.

FIGS. 6–8 show the sole plate in as-cast condition, with ears 56 and 57 which are later partially cut-away or trimmed to match the contour of the wooden body 16, during assembly. Also, plate portion 58 is trimmed during such assembly. The symmetric construction is such that the FIGS. 5–7 sole plate may be used on either left or right handed club heads.

I claim:

1. In golf club head having multiple wooden laminations which extend in vertically stacked relation, and generally horizontally, the head having a front face, a top surface and a metallic sole plate beneath the laminations, the sole plate having a downwardly projecting keel, which extends rearwardly relative to the front face of the head, the combination comprising:

(a) there being a recess which extends generally vertically in and perpendicular to said laminations from the sole plate upwardly to the head top surface, (b) and a bolt extending in said recess, (c) the bolt connected with the sole plate and keel above the bottom of said keel, (d) and the bolt including a head defining flange means proximate said head top surface, the bolt acting to clamp said laminations toward one another between said flange means and the sole plate, (e) said recess defining a bore and a counterbore in the laminations, the counterbore receiving said flange means and the bolt having a shank received in the bore below said counterbore, (f) and including adhesive bonding material in said bore and counterbore bonding the bolt and flange means to the laminations which are wooden, (g) the keel having a downwardly convex surface, which is forwardly and rearwardly elongated, the bolt extending downwardly into the keel, the sole plate having underside faces at opposite sides of the keel, each face having downward concavity, the keel forming a second recess receiving the bolt, the recess located between said underside faces having said downward concavity, the bolt threading extending into said second recess.

2. The combination of claim 1 wherein said bolt head has a uniform, finish ground, slot-free, top surface, flush with the top surface of the uppermost wooden lamination.

3. The combination of claim 1 wherein the bolt consists of lightweight metal, and the sole plate consists of metal of greater specific gravity than the bolt.

4. The combination of claim 1 including at least one recess in the sole plate and spaced from the bolt in the forward and rearward direction of the keel.

5. The combination of claim 4 including a weight in said recess of greater specific gravity than the specific gravities of the sole plate and bolt.

6. The combination of claim 4 including a second recess in the sole plate at the side of the bolt opposite that of said one recess, and a weight in the second recess.

7. The combination of claim 1 wherein the plate has side pockets for receiving peninsulas formed by the head, the pockets located at opposite sides of a plane bisecting the bolt and the keel.

* * * * *